United States Patent [19]

Pauliukonis

[11] Patent Number: 4,494,912

[45] Date of Patent: Jan. 22, 1985

[54] ENERGY CONSERVING AIR PUMP

[76] Inventor: Richard S. Pauliukonis, 6660 Greenbriar Dr., Cleveland, Ohio 44130

[21] Appl. No.: 419,011

[22] Filed: Sep. 16, 1982

[51] Int. Cl.[3] ..... F04B 45/04

[52] U.S. Cl. ..... 417/347; 417/395; 137/106

[58] Field of Search ..... 417/347, 401, 395; 137/106; 91/235, 229, 225, 228

[56] References Cited

U.S. PATENT DOCUMENTS

| | | | |
|---|---|---|---|
| 2,092,405 | 9/1937 | Neveu | 91/235 |
| 2,470,087 | 5/1949 | Adams | 91/225 |
| 2,751,889 | 6/1956 | Mohler | 91/225 |
| 3,963,383 | 6/1976 | Hill | 417/401 |
| 4,104,008 | 8/1978 | Hoffman et al. | 417/401 X |

*Primary Examiner*—Leonard E. Smith
*Attorney, Agent, or Firm*—R. S. Pauliukonis

[57] ABSTRACT

An energy conserving air pump includes an air operating pump section and a separate fluid pumping section capable of handling pure fluids in concentrate form or in solution, and operates by the use of a single slug of air in the air operating section to shift a shuttle valve of differential diameter incorporated therein from a first to a second positions while simultaneously allowing air to actuate reciprocating pumping members incorporated into said fluid pumping section dispensing with complicated valves of conventional air pumps and allowing an automatic cycle repetition with the same air slug from a first pump atmospheric position which permits pump priming with suction of fluids pumped therethrough to a second pump discharge position, and vice-versa.

7 Claims, 4 Drawing Figures

ENERGY CONSERVING AIR PUMP

This invention relates to fluid driven reciprocating pumps in general, and to air operated pumps which permit energy conservation in particular.

Most fluid-pressure actuated pumps comprise a pair of cooperating diaphragm units coaxially arranged and connected rigidly to one another wherein the diaphragm divides the pump housing into a distinctly separate pump section or a pumping chamber and a pump actuating chamber including connection for supplying a fluid pressure medium. Normally the two component pumps are spaced from each other by an intermediate coaxial connecting member with two actuating chambers facing each other, and the two pumping chambers facing in opposite directions while an actuating rod rigidly interconnects the centers of the two diaphragms so that the pumping stroke of the one diaphragm will coincide with the pump suction of the other diaphragm, while an actuating valve system controls system operation and supply of the working fluid to admit pressure into the first actuating chamber while the second actuating chamber is to exhaust with movement of the valve control members between end positions effected by the reciprocating movements of the diaphragm assembly requiring for each stroke diaphragm makes a new supply of the working fluid in each actuating chamber, consuming substantial amounts of the working fluid. The same pertains to air-pressure operated membrane pumps, and in both of such cases energy, in terms of compressed air, is being wasted. The design and the operation of pumps in existance need improvements. A general object of this invention is to provide a simplified pump design for use with pressurized air.

Specifically, a main object is to provide an energy conserving pumping system wherein the pump actuation is simplified so as to provide means for air utilization twice before exhausting, for double stroking pumping members of the pumping chamber substantially by a single slug of air thereby facilitating said energy conservation. It is furthermore an object of the present invention to adapt energy conserving techniques for pump operation irrespective of the pump classification, be it a diaphragm or a piston type reciprocating pump or even a membrane pump.

According to the invention, the energy conserving air pump includes a pump operating member and a pumping member inside a housing means in which a pump operating member such as a differential diameter shuttle valve means is movable inside the housing means in an inter-related operable means with the pumping member, defining a chamber, reciprocatingly so as to move along with the operating member between suction inlet and pressure discharge strokes. Obviously, the pumping member divides the pump chamber into a liquid space on one side of the pumping member and an air space on the other side of the pumping member. Therefore, a liquid supply and discharge means communicates with the liquid space of the pump chamber comprising a distinct pumping section of the pump, totally separated from pump operating section either by a set of pistons or diaphragms incorporated therein in accordance with conventional practice, or by a novel membrane from elastomeric materials compatible with fluids pumped and capable of stretching within elastic limits in response to the working fluid pressures compressed air or the like may provide. Most important feature is, however, the provision of using the working fluid in a novel way that conserves energy. This can be done only when the pump operating section employs the noted differential diameter shuttle valve means which include a differential diameter piston, centrally ported by a small pilot port for working fluid flow to help piston shifting from a first original atmospheric position to a second energized position when subjected to the working fluid pressure in communication therewith, simultaneously energizing the pumping section to urge the pumping member move along its pressure discharge stroke, and an automatic piston return to the first position when pressurized working fluid penetrates through via said small pilot port into the piston backside which normally is of considerably larger diameter than the front side thereof exerting an end force larger than the front end force initially acted to start piston motion, facilitating piston return by the same slug of air, unlike that found in the conventional pump requiring for each piston position change a new slug of air to facilitate pump operation. When the differential diameter piston returns to the original first atmospheric position by the differential end force so developed by the working fluid, both the pump operating and the pumping sections become atmospheric due to a facility for air exhaust provided therein unloading the system at the end of the cycle to allow fluid suction in pumping section with cycle repetition in exact fashion the description above indicates, resulting in great energy conservation due to reduction of the amount of working fluid used during the pump operation which may be a double acting or a single acting pump as will be seen from the description by reference to the drawings that follows.

IN THE DRAWINGS

Figure 2:
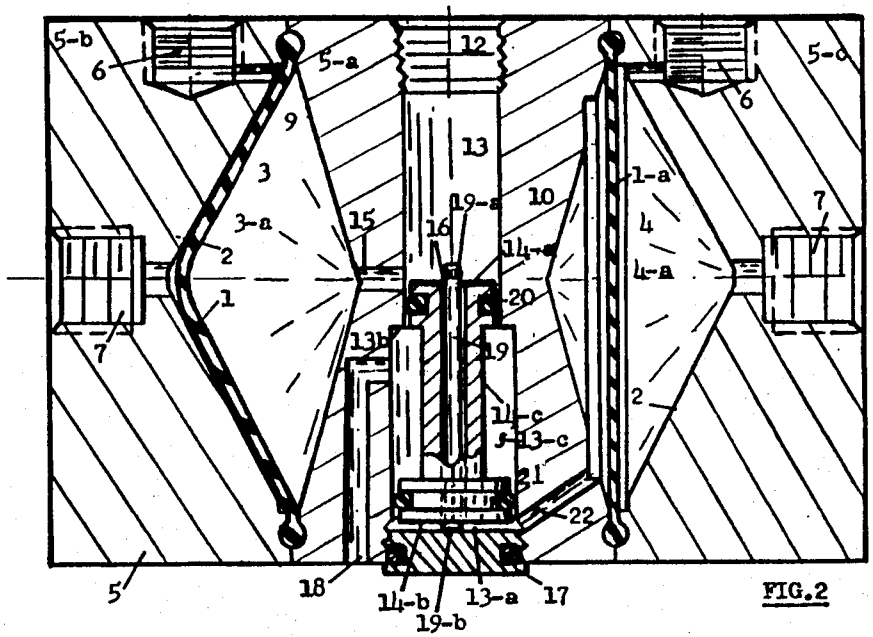
FIG. 2 is a cross-section of an identical pump to that of FIG. 1 except for modification of pilot port operating means inside the differential diameter piston, shown in a second position with one of the membranes energized by the working fluid pressure urging the pumping member to move along its pressure discharge stroke.
Figure 1:
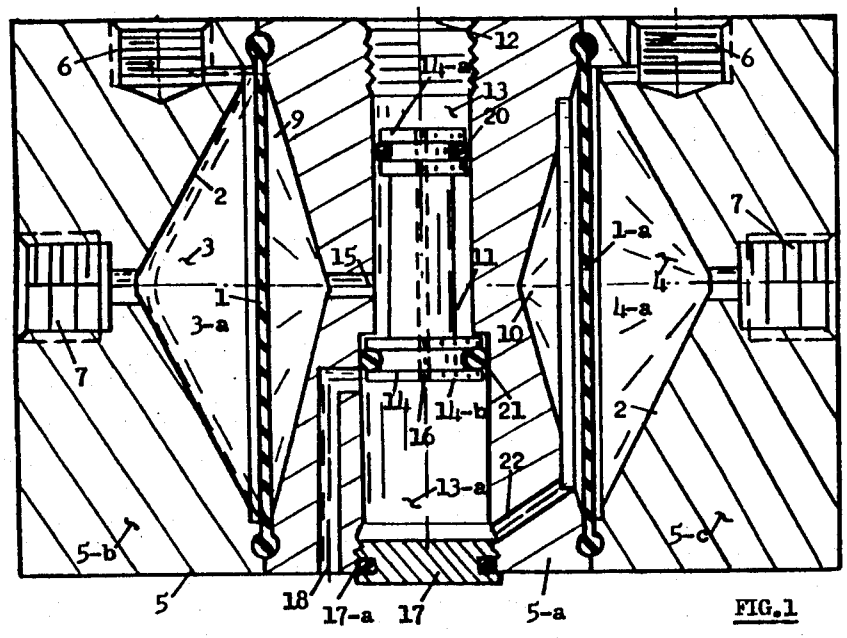
FIG. 1 is a cross-section of a double-acting membrane pump operated by a shuttle valve which includes a differential diameter piston with energy conservation means, shown in a first normally atmospheric pump position.

Refering now to FIGS. 1 and 2, a pumping member 1 which in the illustrated example is in the form of an elastomeric circular membrane capable of stretching elastically when energized by a pressurized working fluid to conform to conically contoured pumping chambers 3 and 4 of housing 5, in practice member 1 can be a standard diaphragm or take a form of a suitable piston. FIG. 1 shows in cross section membrane 1 unstretched when pump is in a first atmospheric position, while FIG. 2 identifies the same membrane 1 in energized position stretched against a conical pump seat 2 to conform thereto, without fear of membrane penatration diaphragm pumps often experience, when said pump is set into a second pump energized position. The pumping member 1 divides the pump chambers 3 and 4 into a liquid space 3-*a* and 4-*a* respectively, provided with a set of ports 6 and 7 for supply and discharge of fluids pumped therethrough, and a gas space 9 and 10 in communication with a centrally spaced pump operating section 11 as viewed in FIGS. 1 and 2, clearly identifying two distinct pump sections of which a first pumping section handles fluids pumped via space 3-*a* and 4-*a*, such as pure liquids or solutions thereof, while a second pump operating section handles working fluid under pressure, be it a compressed air or gas, for energizing the first pumping section in an operable relationship therebetween when allowed to enter spaces 9 and 10. Pump housing 5 may be sectioned as shown in FIGS. 1 and 2 so as to facilitate an easy pump assembly, and a section 5-*a*, substantially central to sections 5-*b* and 5-*c*, is shown to contain the shuttle valve means of the pump operating section which serves the two actuating pump chamber spaces 9 and 10 facing each other therein while the two pumping chambers 3 and 4, provided with conical pump seat 2, face in opposite directions in each respective pump housing section 5-*b* and 5-*c*, at each pump housing end which in the illustrated case of FIGS. 1 and 2 are provided with the fluid discharge ports 7, substantially central thereto.

Since sections 5-*b* and 5-*c* are identical and include the fluid supply ports 6 making these parts interchangeable, the emphasis will be place to section 5-*a* which in effect is the air actuated operating section of double acting pumps FIGS. 1 and 2 identify with energy conservation subject to the present invention.

Shown in FIGS. 1 and 2, section 5-*a* is located substantially central to housing 5 and includes a shuttle valve means consisting of a differential diameter piston 14 with seals slidably movable inside a differential diameter bore 13 provided with air porting means in communication with the first pumping section incorporating the reciprocating pumping member 1, including a first supply port 12 to allow entering of the working fluid into the bore 13 to exert pressure-end-force over a piston small end 14-*a* in order to start moving the shuttle valve means from the first atmospheric position in FIG. 1 indicates to the second piston energized position of FIG. 2, allowing fluid communication with space 9 via port 15, central to membrane 1, simultaneously feeding larger diameter bore portion 13-*a*, sealably closed by plug 17 provided with seal 17-*a*, via air pilot port 16 inside the center of piston 14 to energize piston backside 14-*b* of larger diameter than the diameter of small piston end 14-*a*, exerting a larger opposite pressure-end-force capable of an automatic piston return to the original first position due to existance of a differential end force single slug of air entering supply port 12 provides to initiate this and other events that follow with conservation of energy.

It should be noted from FIG. 1 rather clearly that the bore portion 13-*a* represents a large chamber behind piston backside 14-*b* when piston 14 is in the first position while FIG. 2 shows little space 13-*a* behind piston backside 14-*b* when piston is in the second position against plug 17. Space 13-*a* in both FIGS. 1 and 2 is shown in communication with either atmosphere via an air port 18 or the gas space 10 via an air port 22 or both, depending on the location of piston 14 inside bore 13. Conversely, when piston 14 is in the location of FIG. 1, both ports 18 and 22 communicate via bore portion 13-*a* rendering space 10 atmospheric as well. And when piston 14 uncovers air port 15 as is the case of FIG. 2, space 9 becomes energized while air port 16 of FIG. 2, incorporating a central actuating rod 19 provided with seal 19-*a* which contains port 16 normally closed until rod end 19-*b* abuts plug 17 opening port 16 to allow air flow into the space 13-*a* behind piston backside 14-*b* and start feeding space 10, initiating discharge cycle of fluid pumped through liquid space 4-*a* when membrane 1-*a*, identical to membrane 1, of pumping chamber 4 becomes reciprocatingly shifted therein by the working fluid entering space 10 via port 22, thereby performing additional function by the same slug of air that actuates space 9 of the first chamber 3, in identical fashion displacing fluid from chamber 4, consistent with operation of double acting pumps in existance, except at less cost in pump operation due to identified energy conservation present design provides. As soon as the membrane 1-*a* bottoms against seat 2 elastically, pressure behind piston backside 14-*b* increases to that of the working fluid pressure at port 12, and piston 14 enters return cycle from the second to the first positions unloading quickly space 9 via air port 18 in communication with air port 15 by way of piston annulus 13-*c* created between piston shank 14-*c* spaced along the length of piston 14 and sealed securely by small and large piston seals 20 and 21 respectively during the piston position change until piston 14 completes the cycle when stopped by shoulder 13-*b* permitting unloading of space 10 via air ports 22 and 18, more clearly visible from FIG. 1. In turn, membranes 1 and 1-*a* are set into reciprocating conditions each time piston moves inside bore 13 constituting an inter-related operable means of the pump wherein elastic constans of such membranes aid in unit operation in that each cycle is associated with elastic stretch of the membranes during liquid discharge from spaces 3-*a* and 4-*a* respectively by the working fluid entering spaces 9 and 10 respectively, and also elastic membrane return to the original condition when the working fluid escapes via a single air discharge port 18 with associated suction of fluids pumped into the individual liquid spaces 3-*a* and 4-*a* respectively rather automatically by novel means which defy convention in pump design and operation.

With reference to piston 14, it is evident that the air port 16 can either be open as FIG. 1 shows or it can be provided with a control rod 19 shown in FIG. 2, depending on application, flows, pressures and operational requirements. Suffice it to say that in some cases it is better to operate with open air port 16, in particular with large size pumps, while in others it may be beneficial to use piston 14 with actuating rod 19, according to experimentation therewith. It should be understood, however, that without the use of differential diameter piston 14 inside the differential diameter bore 13 the pump would not operate, regardless of the choice of piston port 16. Ergo, the modification of piston air port 16 identifies a minor variance within the scope and the spirit of the invention and complies with statutory rules allowing more than one species of an invention to be specifically claimed.

Figure 3:
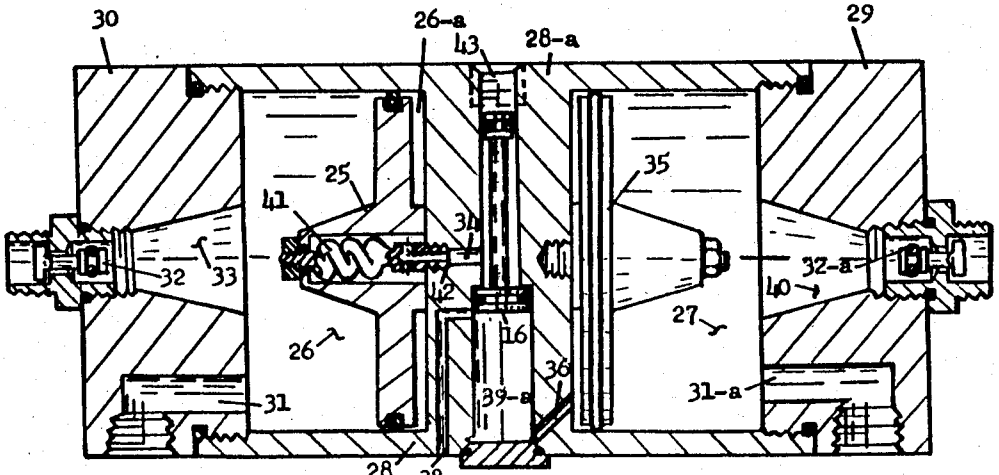
FIG. 3 is a cross-section of a double-acting piston pump operated by the same shuttle valve means of FIG. 1 shown in a first normally atmospheric position.

The same pertains to a design modification depicted in FIG. 3 wherein the only change is in the reciprocating pumping members rather than in the basic design that employs shuttle valve means with energy conservation for pump operation subject to this invention in all details.

As can be seen from FIG. 3, the pumping member takes a form of a suitable piston 25 or 35 inside pumping chambers 26 and 27 at each housing end respectively of a housing 28 which in the illustrated case is provided with end closure means 29 and 30 respectively, representing in effect a double acting pump, characterized by the fact that when one piston, in our case piston 25 is energized to enter fluid discharge phase for emptying contents from chamber 26 via exhaust port 31, closing a check valve 32 of a fluid supply port 33 while being pressurized by the working fluid entering air space **26-*a* via central air port 34 in identical fashion to that of FIGS. 1 and 2, the other piston, in our case piston 35 is in suction and atmospheric because of air ports 36 and 38 in communication via space 39-*a* identical to space 13-*a* of FIGS. 1 and 2, and vice-versa. Suction of fluid into chambers 26 and 27 of FIG. 3 proceeds by way of fluid supply ports 33 and 40 provided with check valves 32 and 32-*a* in each respective housing closures 29 and 30, while discharge of fluids from chambers 26 and 27 takes place by way of exhaust ports 31 and 31-*a*. It should be stated here that end closures 29 and 30 are identical in all respects, and as such are interchangeable. In fact, fluid discharge ports of both end closures may be provided with check valves inside threaded sections of 31 and 31-*a* FIG. 3** identifies if so specified by the system this pump is to serve, although in some rare cases fluid discharge ports need no check valves at all due to other restrictions in downstream piping thereof.

Since membrane 1 which operated by elastic constants in terms of returning to the first original position when de-energized was replaced in FIG. 3 by pistons, it was necessary to incorporate a tension spring 41 one end of which is anchored to the center of the section **28-*a* of housing 28 incorporating the shuttle valve means identical to that of FIGS. 1 and 2, while the other end of spring 41 is anchored to the center of the pistons 25 and 35 by way of threaded connection shown in cross-section by reference to piston 25 while piston 35, not sectioned, may have similar attachment for spring 41 thereto. From a supply port 43 air flows to an air port 42 to feed an air space 26-*a* of piston underside via an opening in the threaded spring end 42 shown in FIG. 3 in order to reciprocatingly move piston 25 or 35 from the first original atmospheric position to the second piston energized position (not shown) in exactly the same operating fashion pump operation proceeded when describing the operation of the double acting pumps of FIGS. 1 and 2. To prevent redundance, no further description of the pump of FIG. 3** will be entered.

Figure 4:
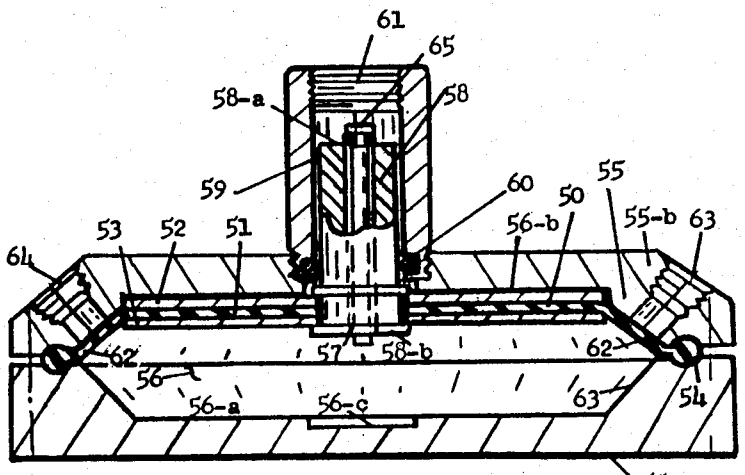
FIG. 4 is a cross-section of a single acting diaphragm pump operated by energy conserving principle wherein a diaphragm plate acts as a larger diapmeter end of the differential diameter piston shown in FIGS. 1, 2 and 3.

In FIG. 4 the pumping member takes form of a suitable diaphragm 50 which includes a conventional construction thereof with a membrane 51 of elastomeric or plastic material sandwiched between two rigid plates 52 and 53 securely from each side of membrane 51 so as to be anchored peripherally at 54 by appropriate means inside two sections **55-*a* and 55-*b* of pump housing 55 dividing pump chamber 56 into an air actuating space 56-*a* shown energized by the working fluid entering central port 57 of piston 58 partially sectioned and secured sealably to the liquid space 56-*b* (not shown) together with the pump operating section 59 provided with a piston seal 60 which separates the pumping section from the actuating section during pump cycling and the position change of the diaphragm reciprocatingly inside pump chamber 56 in response to pressure end forces working fluid such as compressed air or gas entering port 61 which when connected to a 3-way valve may also serve as the exhaust port for the working fluid, exerts over first piston end 58-*a* of smaller diameter, moving piston 58 together with diaphragm assembly 50 secured to the piston 58 permanently from the first atmospheric position shown in FIG. 4 which position is at the end of the stroke with diaphragm energized as well, as earlier indicated, to the second position for pump suction when piston end 58-*b* with or without an actuating rod 65 touches bottom of space 56-*a* at a recess 56-*c* shown, increasing fluid space 56-*b* to its maximum while diaphragm assembly, in particular free ends 62 thereof conform to the housing taper 63 identified therein permitting fluid supply into liquid space 56-*b* via port 63 which may be provided with a check valve (not shown) for a subsequent fluid discharge via port 64 therefrom when working fluid enters under plate 53 the air space 56-*a*, exerting considerably larger pressure end-force to that small piston end 58-*a* experienced, capable of an automatic piston return to the original atmospheric position FIG. 4 illustrates. In turn, operation of piston with energy conservation materializes in identical fashion to that of FIGS. 1, 2 and 3 except that in FIG. 4 there is a single pump chamber wherein a single slug of air performs a double acting function with energy conservation instead of double pumping compartments working in unison by reciprocation in a fashion already described. FIG. 4** design can be adapted to duplicate operation of double pumping compartments as well, further illustrating the versatility of the present invention with energy conservation that employs shuttle valve operating means for pumps of the future.

Obviously other variations are possible with the above-described structure without departing from the scope and the spirit of this invention described and claimed herein.

What is claimed is:

1. An energy conserving air pump comprising:

a pump operating and a pumping sections in a pump housing provided with a first air actuated pump operating section located substantially central thereto including a valve chamber with a shuttle valve means incorporated therein and consisting of a differential diameter piston slidably movable inside a differential diameter bore thereof provided with air porting means including a supply and exhaust port means for compressed air flow therethrough and into adjacent second pumping section provided with a chamber separated by a reciprocating pumping means including movable members thereof a first side of which defining a gas space therein when pressurized by said air delivered thereto from said first pump operating section via ports incorporated therein until said air is discharged therefrom via said exhaust port means constituting a full reciprocating cycle pumping requires while a second side of which defining a liquid space thereof is adaptable of fluid pumping from a first fluid supply to a second fluid discharge port means when said pumping members become reciprocatingly shifted therein by said air, said pump operating section and said pumping section in combination operating in an inter-related function so that when said first pump operating section becomes energized by said pressurized air entering said supply port means via a first pump operating port in communication with said valve chamber, said differential diameter piston shuttles therein from a first pump atmospheric position to a second pump energized position and back thereby allowing a simultaneous fluid pumping by the air action over said pumping members until said pressurized air completes the cycle therein and becomes exhausted therefrom, rendering said pump operating section atmospheric, and vice-versa, said differential diameter piston includes a first smaller diameter piston end which when pressurized by said air entering said supply port means exerts a first pressure-end-force to said differential diameter piston urging said piston position change until said pressurized air passes an air pilot port incorporated centrally thereto to exit a second larger diameter piston end for exerting a second larger pressure-end-force than said first end force to urge an automatic piston return to said first pump atmospheric position as a result of a force differential over said differential diameter piston for piston unloading at the end of the cycle via said exhaust port means provided therein to permit cycle repetition with operation of said pumping section when said shuttle valve means becomes energized, and vice-versa, said pressurized air performing dual function over said differential diameter piston automatically by first shifting said piston from said first to said second positions with a single slug of air which also shifts said pumping members before exhausting into the atmosphere during each operating cycle of the pump.

2. An energy conserving air pump as in claim 1 wherein said shuttle valve means of said pump operating section serves two individual pumping sections incorporated into said pump housing and spaced adjacent said valve chamber from opposite sides thereof wherein when said piston is in said second pump energized position, an air porting means of a first individual pumping section permits air to energize a first reciprocating pumping member thereof for discharging fluid from said liquid space until ample air passes said air pilot port of said piston to energize a second reciprocating pumping member spaced in a second individual pumping section resulting in a gradual increase of said second larger pressure end force that urges said subsequent automatic piston return to said first pump atmospheric condition while simultaneously unloading said first reciprocating pumping member from air pressure during said piston position change via said exhaust port means that communicates with said air porting means of said first individual pumping section via an annulus created therein between an outside diameter of said piston and said bore of said valve chamber first before said piston assumes said first atmospheric position to simultaneously permit unloading said second reciprocating pumping member from air pressure when, at the end of said piston stroke, said exhaust port means becomes open for communication with said second individual pumping section.

3. An energy conserving air pump as in claim 1 wherein said reciprocating pumping members are elastomeric circular membranes capable of stretching elastically when energized by said pressurized air and adaptable of an elastic return to the original first position when unloaded after pressurized air is exhausted therefrom.

4. An energy conserving air pump as in claim 1 wherein said reciprocating pumping members are pistons which are anchored therein by tension springs for return to said first atmospheric position when said pressurized air is exhausted therefrom.

5. An energy conserving air pump as in claim 1 wherein said rciprocating pumping member is a diaphragm.

6. An energy conserving air pump as in claim 1 including a check valve means in said fluid supply and discharge port means of said second pumping section.

7. An energy conserving air pump as in claim 1 wherein said air pilot port incorporated centrally into said differential diameter piston includes an actuating rod with a seal for control of said working fluid flow into said second larger diameter piston end to provide said automatic piston return to said first atmospheric position, said actuating rod long enough to uncover said seal when said piston assumes said second position.

* * * * *